United States Patent [19]

Corral et al.

[11] 3,966,157

[45] June 29, 1976

[54] HEAVY WEIGHT HANGER

[76] Inventors: Jose Corral; George Spector, both c/o George Spector, 3615 Woolworth Bldg., 233 Broadway, New York, N.Y. 10007

[22] Filed: Nov. 6, 1973

[21] Appl. No.: 413,315

[52] U.S. Cl. ..... 248/217; 248/493

[51] Int. Cl.[2] ..... A47G 1/16

[58] Field of Search ..... 248/71, 217, 216, 218, 248/219, 308, 304, 493, 494, 497

[56] References Cited

UNITED STATES PATENTS

| | | | |
|---|---|---|---|
| 165,206 | 7/1875 | Brown | 248/217 |
| 769,794 | 9/1904 | Fowler | 248/218 |
| 1,651,392 | 12/1927 | Honigbaum | 248/301 X |
| 1,999,575 | 4/1935 | Reuter et al. | 248/497 |
| 2,125,770 | 8/1938 | Dabroski | 248/493 |
| 3,298,651 | 1/1967 | Passer | 248/217 |

*Primary Examiner*—J.Franklin Foss

[57] ABSTRACT

An improved hanger for supporting picture frames on a wall, the hanger being designed in different models so to selectively support either a heavy, medium or light weight frame; each of the different models being stamped out from flat sheet metal material and then configurated so to include projections for piercing into a vertical wall, and also including a bent up hook over which the picture frame wire can be hooked.

1 Claim, 12 Drawing Figures

HEAVY WEIGHT HANGER

This invention relates generally to picture hanging devices. More specifically it relates to hangers.

A principal object of the present invention is to provide an improved design of hanger made of sheet metal and which can be made as a heavy weight, medium weight or light weight model.

Another object is to provide an improved hanger which does not damage a wall, but leaves only slight marks after removal so that there is no extensive wall repairs afterward.

Other objects are to provide an improved hanger that is simple in design, inexpensive to manufacture, rugged in construction, easy to use and efficient in operation.

These and other objects will be readily evident upon a study of the following specification and the accompanying drawing wherein.

Figure 1:
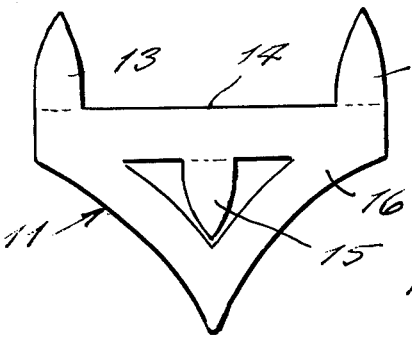
FIG. 1 is a flat blank from which one design of the invention is formed.
Figure 2:
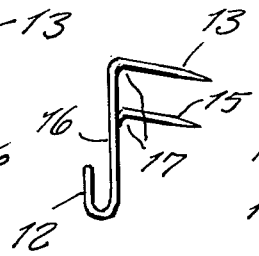
FIG. 2 is a side edge view thereof shown bent into final form.
Figure 3:
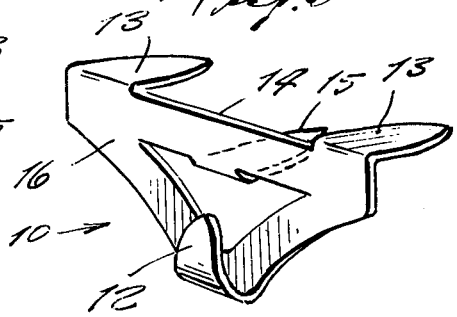
FIG. 3 is a perspective view thereof.

Reference is now made to the drawing in detail, and more particularly to FIGS. 1 to 3 at this time, wherein there is a heavyweight hanger 10 according to the present invention and which is stamped out of flat sheet metal, as shown in FIG. 1, so to form a flat blank 11 which is then bent or formed into the shape shown in FIGS. 2 and 3 by including a plurality of prongs for driving into a wall, and a hook 12 over which a picture or mirror frame is hooked. The prongs consist of a pair of prongs 13 along the upper edge 14 of the blank each prong being at a side end of the edge, and also a third prong 15 which protrudes from a mid-center area of a flat body portion 16 of the hanger. All the prongs are bent rearwardy at a slightly downward angle so to form an acute angle 17 between the underside of the prong and a rear side of the body portion 16. The hook 12 is formed at a lower end of the blank and is rounded forwardly as shown.

In use, it is now evident that when the prongs are driven in a wall, the acute angle thereof, as described allows them to support a relatively great weight securely. After a hanger is removed from a wall, due to no longer being needed, the thin flat prongs thus leave only a thin flat hole which cannot be as readily seen as a round nail hole.

Figure 4:
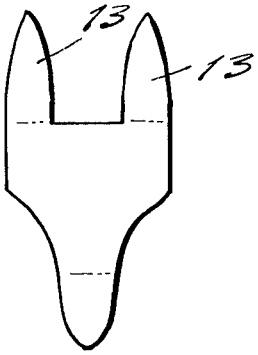
FIGS. 4, 5 and 6 are similar views to FIGS. 1, 2 and 3 respectively and showing a modified design of the invention.
Figure 5:
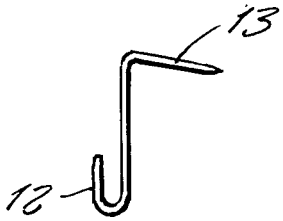
Figure 6:
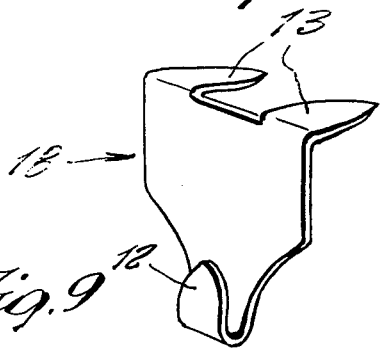

In FIGS. 4 to 6 a medium weight hanger 18 is likewise made from sheet metal but includes only the above described top edge prongs 13 and the hook 12 all of which are bent as above described. Being for medium weight use, the hanger 18 does not require the third prong, above described.

Figure 7:
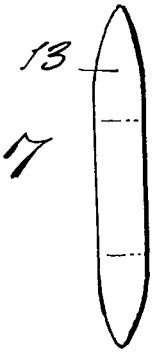
FIGS. 7, 8 and 9 are similar views to FIGS. 1, 2 and 3 respectively and showing still another modified design.
Figure 8:
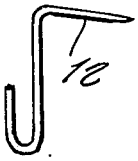
Figure 9:
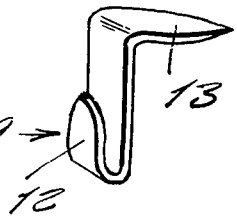

In FIGS. 7 to 9 a light weight hanger 19 made likewise of sheet metal includes only a single prong 13 at one end and a hook at the other end, and each of which is bent as above described.

Figure 10:
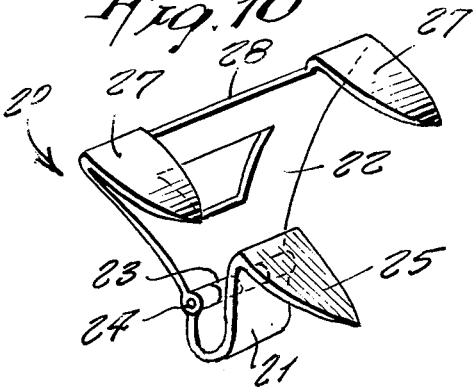
FIGS. 10 and 11 show still another modified design of a stronger and more safe proof hanger that accordingly can be made of thinner material while still holding a heavy weight without the bottom hook from straightening due to the load; the bottom hook lip being pivotally secured to the two top hooks.
Figure 11:
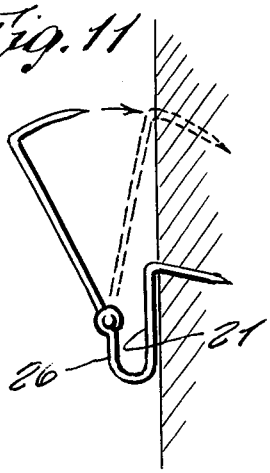

In FIGS. 10 and 11 another modified design of hanger 20 is comprised of a formed sheet metal part 21 and another formed sheet metal part 22 each of which at one end are rolled over so to form a hinge 23 fitted with hinge pin 24. The part 21 at one end has a prong 25 bent at acute angle as described; the opposite end thereof being forwardly bent so to form a hook 26; it being noted that the hinge 23 forms the terminal end of the hook. The other part has a pair of prongs 27 along the edge 28 which is at the end opposite to the hinge. The prongs are bent as described above.

In use, the hanger 20 is mounted on a wall by first driving the prong 25 in the wall. A picture frame wire is then hung on the hook, after which the part 22 is pivoted upward and the prongs 27 are driven into the wall. This hanger is of greatest strength in view that the hook is prevented from straightening out due to the hook tip being held up by the prongs 27.

Figure 12:
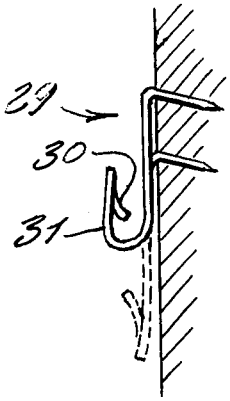
FIG. 12 shows still another modified design in which a struck out spur on the end of the hook serves as a safety to hold a supported picture wire in case the hook straightens out due to the load, as shown by dotted lines.

In FIG. 12 a hanger 29 of sheet metal includes a spur 30 struck out on its tip so that in case the hook 31 straightens out due to the picture frame weight, the frame wire gets hung up behind the spur, thus preventing the frame from dropping to a floor.

Thus various forms of the invention have been provided.

While various changes may be made in the detail construction, it is understood that such changes will be within the spirit and scope of the present invention as is defined by the appended claims.

What is claimed is:

1. A wall hanger of generally triangular shape having an upper wide portion with symmetrical spaced end prongs and a tapered narrow lower apex portion having a point, including a lower prong, vertically beneath and horizontally midway between the end prongs in combination with a U-shaped hook to support an object to be hung thereon, wherein said hook is disposed integrally at the same apex portion below the lower prong and having an outer end spaced from a wall support when said prongs are driven into said wall support, wherein the upper portion is pivotally connected to the apex portion at said outer end of the hook, said lower prong forming an integral transverse projection extending from the hook away towards the wall support and away from the said outer end of the hook, whereby the said upper portion encloses the hook and is spaced from the wall when mounted.

* * * * *